United States Patent [19]

Colbachini

[11] Patent Number: 4,725,326

[45] Date of Patent: Feb. 16, 1988

[54] STRIP-DISPENSER CARRIAGE FOR USE IN THE PRODUCTION OF TUBULAR ELEMENTS

[76] Inventor: Giuseppe A. Colbachini, Via Fossona, 77, 35030 Cervarese Santa Croce (Padova), Italy

[21] Appl. No.: 553

[22] Filed: Jan. 5, 1987

[30] Foreign Application Priority Data

Jan. 23, 1986 [IT] Italy ..... 19162 A/86

[51] Int. Cl.[4] ..... B32B 1/00

[52] U.S. Cl. ..... 156/350; 156/425

[58] Field of Search ..... 156/425, 428–429, 156/443, 184, 189, 195, 172, 173, 175, 350, 361; 493/299; 282/158 R, 26.3, 26.43, 26.44, 26.45, 47.13, 158.2, 158.4 R

[56] References Cited

U.S. PATENT DOCUMENTS

| | | | |
|---|---|---|---|
| 3,300,355 | 1/1967 | Adams | 156/189 |
| 3,586,561 | 6/1971 | Wesch | 156/172 |
| 3,928,939 | 12/1975 | Edwards et al. | 493/299 X |
| 4,143,834 | 3/1979 | Hara et al. | 242/158 R |

*Primary Examiner*—David Simmons

*Attorney, Agent, or Firm*—Bucknam and Archer

[57] ABSTRACT

A strip-dispenser carriage for use in the production of tubular elements by winding a flat strip helically onto a rotating core comprises a carriage frame having a slide slidably mounted thereon for displacement with respect to the carriage parallel to its direction of movement along the rotating core. The slide carries a flat coil of strip which is unwound from the coil to be wound on the core as the carriage moves along the length of the core. The relative movements of the slide, carrying the coil, with respect to the carriage makes it easier to maintain a constant winding pitch of the strip onto the core.

6 Claims, 2 Drawing Figures

STRIP-DISPENSER CARRIAGE FOR USE IN THE PRODUCTION OF TUBULAR ELEMENTS

BACKGROUND OF THE INVENTION

In the production of tubular elements it is known to wind an elongate strip of material in a helix on a core of very great length; often successive layers of different strip material are wound to form the body of the tubular element: this process can be used in forming both rigid or flexible tubular elements, but is particularly suitable for the latter, and the elongate strip material used may have different characteristics depending on the characteristics which it is desired to obtain for the tubular elements to be formed.

The strips must be wound on the cores with a cylindrical helical conformation and one technique currently used to achieve this is to rotate the core about its axis whilst the strip is delivered from a flat coil which is caused to travel longitudinally alongside the core itself. To obtain a finished product of high quality it is necessary that the strip be wound on the core with the maximum precision and with rigorous constancy of the winding pitch so as to avoid both overlapping of adjacent turns and the occurrence of spaces between adjacent turns. The former occurs if the pitch is too short, in which case there is an unwanted overlapping of adjacent turns of the strip, whilst if the pitch is too long there would be a spacing between adjacent turns of the strip causing in each case unwanted variations in the thickness of the finished tubular element.

With current techniques the application of the various layers of strip is effected entirely manually by means of an operator who is placed alongside the rotary core and utilising only his own ability and experience, controls the speed of advance of the strip-delivery carriage as the strip is drawn off by the core itself during its rotation. This work is extremely repetitive, very monotonous and extremely tedious for the operator and, inevitably, because the quality of the finished produce depends entirely on the concentration and ability of the operator, a uniform quality is not always obtained.

Various attempts at automation of such systems have been tried in the past without success because it has not been possible to match the exact speed of translation of the strip-delivery carriage along the axis of the core with the required speed at any instant, thus causing a non-uniform winding of the strip.

OBJECTS OF THE INVENTION

One object of the present invention is that of eliminating the above-mentioned disadvantages by providing a strip-dispenser carriage which is particularly designed for the production of tubular elements, especially flexible tubular elements, which will allow the possibility of uniform and precise winding of the various layers of the strip around the rotary core to be obtained in a completely automatic manner.

Another object of the present invention is to provide a strip-dispenser carriage which allows any possible variations in the speed of translation of the carriage along the core, which may be needed to compensate for slight non-uniformity in the thickness of the strip, to be obtained in an entirely automatic manner thus being able completely automate the strip-dispensing part of the production cycle. Such linear speed variations may also be needed, for example, to accommodate variations in the absolute speed of rotation of the core.

A further object of the present invention is to provide a strip-dispenser carriage for use in the production of tubular elements, which is structurally simple and also able to offer the widest guarantees of reliability and safety in use.

Still a further object of the present invention is to provide a strip-dispenser carriage, particularly designed for the production of flexible tubular elements, which is easily obtainable starting from elements and materials which are commonly commercially available and which, moreover, is advantageous from an economic point of view.

SUMMARY OF THE INVENTION

According to the present invention, there is provided a strip-dispenser for use in the production of flexible tubular elements by winding a strip helically onto a rotating core, characterised by the fact that it comprises a carriage frame movable substantially parallel to the rotating core onto which the strip is helically wound during production, a slide slidably mounted on the said carriage frame for displacement parallel to the direction of movement of the carriage, a coil of strip mounted on the slide to be wound in a cylindrical helix on the said core, the arrangement being such that during movement of the carriage displacements of the slide take place to maintain the winding pitch on the said core both constant and uniform.

Various other features and advantages of the present invention will become apparent from a study of the following descriptions of a preferred embodiment, in which reference is made to the accompanying drawings, provided purely by way of non-limitative example.

DESCRIPTION OF THE PREFERRED EMBODIMENT

Figure 1:
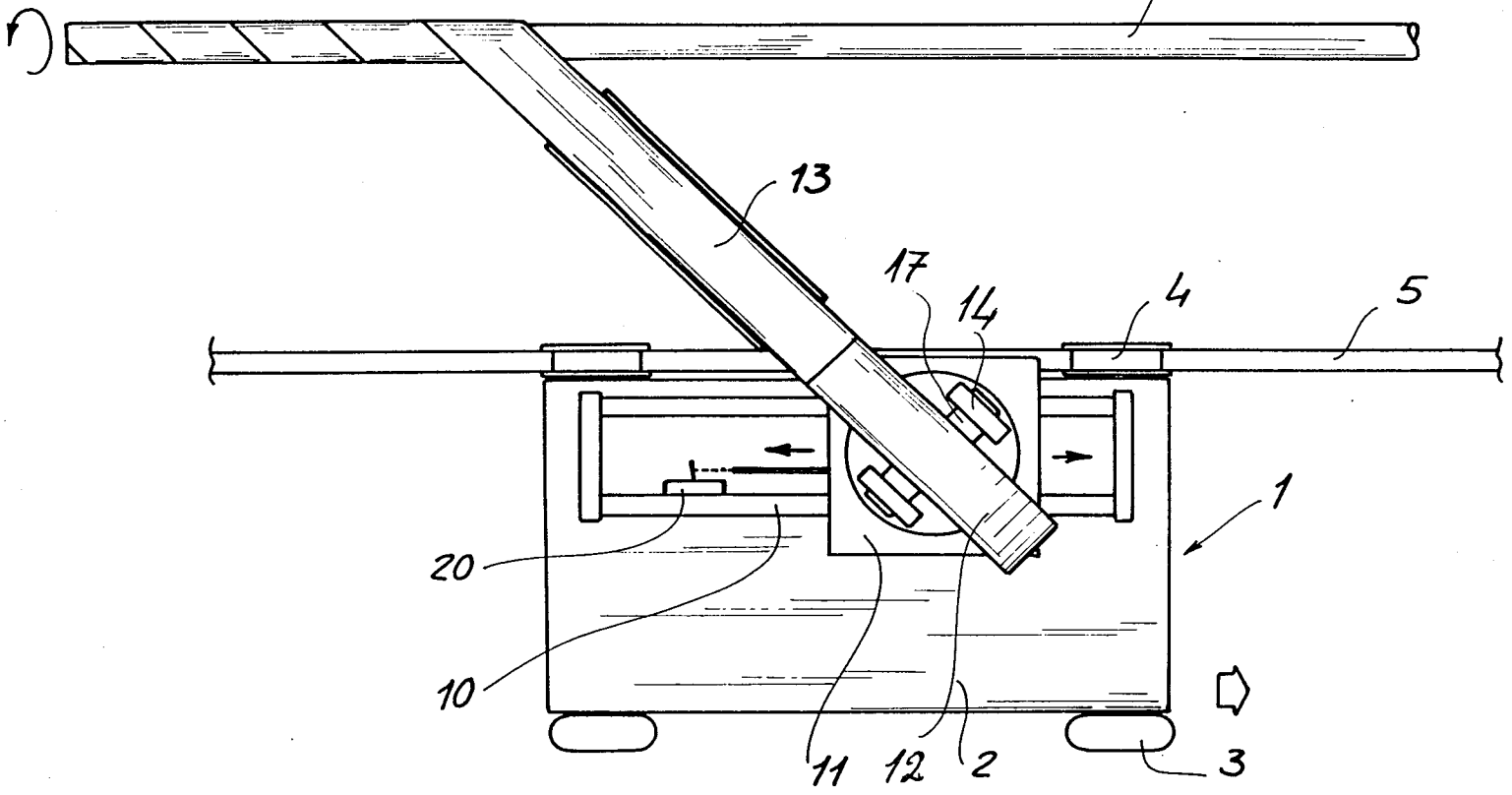
FIG. 1 is a schematic plan view of a strip-dispenser carriage formed as an embodiment of the invention.
Figure 2:
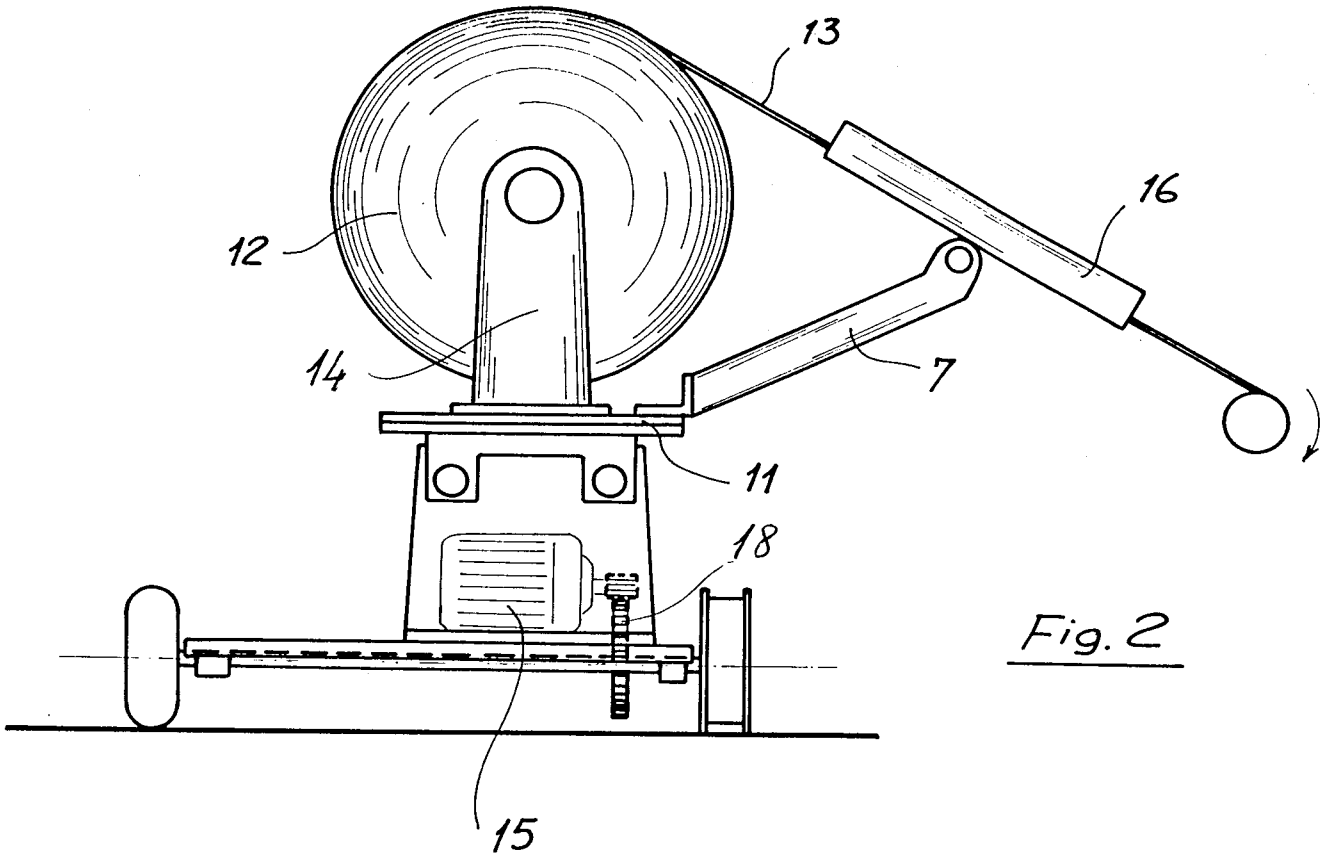
FIG. 2 is a front view of the strip-dispenser carriage of FIG. 1.

Referring now to the drawings, the strip-dispenser carriage, which is generally indicated with the reference numeral 1, has a carriage-mounted frame 2 provided with two ground-wheels 3 on one side and a pair of flanged wheels 4 on the other side for rolling on a guide rail 5 which extends substantially parallel to and alongside a rotary core generally indicated 6. On the upper part of the carriage frame 2 there are two longitudinally extending guide rods 10 along a slide 11 which is slidably guided. The slide 11 has two upstanding arms 14 which support a spindle 17 carrying a flat coil 12 of strip 13 which is to be wound in a cylindrical helix on the rotating core 6.

The coil 12 is supported in such a way as to lie at a fixed angle with respect to the rotating core 6, which in practice determines the pitch of the cylindrical helix in which the strip 13 is wound onto the core 6.

The slide 11 is slidable along the guide rods 10 relative to the supporting frame 2 in such a way as to compensate for possible variations between the axial speed of advance of the winding of the strip as it is being wound in a cylindrical helix on the core 6, and the speed of advance of the carriage itself which, advantageously, is driven by a D.C. motor 15 via a gear transmission 18.

The strip 13 leaving the coil 12, slides in a guide channel 16 which, advantageously, is supported by an arm 7 connected to the slide 11. The position of the slide 11 with respect to the carriage frame 2 is detected by optical sensors 20, (which may of course be any other type of sensor, for example magnetic or electromagnetic of even mechanical limit switches) which send control signals to the motor 15 for obtaining a variation in the speed thereof in dependence on the degree of displacement of the slide 11 from a central position on the carriage frame 2. The motor 15 is normally operated at a pre-set speed to drive the carriage 2 alongside the core 6 in such a way as to maintain a uniform winding pitch of the strip 13 on the core 6.

If there is a difference between the speed of advance of the carriage frame 2 and the axial advance of the winding of the strip 13 on the core 6, the slide 11 is caused to move on the guide bars 10 either by the increased tension in the strip 13 or by a biasing spring (not shown) as a result of a reduced tension in the strip. These movements serve to limit the tension variation in the strip 13 to a value below that at which unnacceptable variations in the regularity of the winding occur. if the available movement of the slide is used up this displacement of the slide 11 with respect to frame 2 is detected by the sensors 20 which provide for consequent adjustment of the speed of the motor 15 to drive the carriage frame 2 in such a way as to tend to bring the slide 11 back to a central position thus adapting the speed of the carriage to the axial speed of advance of the winding of the strip 13 on the core 6.

The carriage 2 is thus able automatically to act to apply the strip 13 onto the core 6 in a precise and uniform manner so that any changes in the speed of advance along the core 6 of the winding of the strip 13, which take place for example, due to slight variations in the thickness of the strip 13, or slight variations in the speed of rotation of the core 6, can be accommodated and closely matched to maintain the winding of the strip 13 at an exactly regular pitch.

The presence of the slide 11 is of great importance since, in practice, it allows the speed of axial advance of the winding of the strip 13 to be separated from the speed of translation of the carriage frame 2 thus allowing the winding of the strip 13 on the core 6 to proceed in a manner which always gives precise and uniform results with the consequence that a product of high quality is obtained.

The invention described herein may have various modifications or improvements introduced thereto without departing from the spirit and scope of the invention as defined in the following claims.

What is claimed is:

1. A strip-dispenser for use in the production of flexible tubular elements by winding a strip helically onto a rotating core, comprising:

carriage means movable substantially parallel to said rotating core onto which said strip is helically wound during production, slide means slidably mounted on said carriage means for displacement parallel to the direction of movement of said carriage, mounting means for mounting a coil of strip on said slide, said slidable slide means being displaceable along said carriage means during movement of said carriage means along said rotating core whereby to maintain the winding pitch on said core both constant and uniform.

2. The strip-dispenser carriage of claim 1, wherein said carriage means is provided with a D.C. motor for driving it along said core during production of said tubular elements.

3. The strip-dispenser carriage of claim 1, wherein said slide means is carried on guide bars on said carriage means for sliding movement with respect thereto.

4. The strip-dispenser carriage of claim 2, wherein said mounting means for said coil of strip carry said coil on said slide with its axis of rotation inclined at a fixed angle with respect to said rotating core.

5. The strip-dispenser carriage of claim 1, wherein said slide means carries, guide channel for guiding the unwinding strip on its path from said coil to said core, an arm connected to said slide supporting said guide channel.

6. The strip-dispenser carriage of claim 1, wherein there are provided sensors for detecting the position of said slide with respect to said carriage means for producing control signals for controlling the speed of said D.C. motor whereby to vary the speed of movement of said carriage.

* * * * *